United States Patent [19]

Hall

[11] 4,187,647

[45] Feb. 12, 1980

[54] MANHOLE EXTENDER ELEMENTS

[75] Inventor: John R. Hall, Atlanta, Ga.

[73] Assignees: Margaret T. Hall, Atlanta, Ga.; James B. Turner, Jr., Raleigh, N.C.

[21] Appl. No.: 844,649

[22] Filed: Oct. 25, 1977

[51] Int. Cl.[2] ..... E02D 29/14

[52] U.S. Cl. ..... 52/20; 404/26

[58] Field of Search ..... 52/19-21; 404/25, 26; 210/163, 170, 172

[56] References Cited

U.S. PATENT DOCUMENTS

| | | | |
|---|---|---|---|
| 684,708 | 10/1901 | McFall | 52/20 |
| 1,260,024 | 3/1918 | Parton | 52/245 |
| 1,639,495 | 8/1927 | Frame | 52/20 |
| 1,987,502 | 1/1935 | Born | 404/25 |
| 3,308,727 | 3/1967 | Hurt | 404/25 |
| 3,618,275 | 11/1971 | Ance | 52/19 |
| 3,629,981 | 12/1971 | McCaffery | 52/19 |
| 3,926,533 | 12/1975 | Binette | 404/26 |
| 3,961,453 | 6/1976 | Couwenbergs | 52/509 |
| 4,121,390 | 10/1978 | Hall | 404/26 |

FOREIGN PATENT DOCUMENTS

| | | | |
|---|---|---|---|
| 2514151 | 10/1976 | Fed. Rep. of Germany | 52/20 |
| 295944 | 4/1932 | Italy | 52/245 |
| 685158 | 12/1952 | United Kingdom | 52/20 |

*Primary Examiner*—James A. Leppink
*Assistant Examiner*—Henry E. Raduazo
*Attorney, Agent, or Firm*—Newton, Hopkins & Ormsby

[57] ABSTRACT

Plastic extender rings for manholes are produced by molding as a unitary member or extrusion or in molded segments and are seated by the use of caulking or other adhesive material. The manhole cover, which is elevated by the plastic ring from the old pavement level to a new pavement level, is rendered more silent to traffic and is seated more evenly. Plastics are employed which will not melt at the application temperature of asphalt but will soften somewhat to conform better to the contour of the manhole cover and/or underlying manhole top ring. Plastic fillers may be employed in the product to regulate plasticity and increase resistance to deterioration from the elements and from ultraviolet.

16 Claims, 8 Drawing Figures

MANHOLE EXTENDER ELEMENTS

BACKGROUND OF THE INVENTION

The prior art for some time has recognized the need for manhole extender means to raise the level of the cast iron manhole cover to a new pavement level when streets are resurfaced. Commonly, a metal extender ring of the necessary thickness is welded to the manhole top ring to raise the level of the manhole cover, as required. Other prior art proposals include adjustable manhole extenders such as screw-threaded extender rings. All of these proposals will accomplish the desired result, but generally speaking they are costly to manufacture or require a good deal of labor for installation, particularly in the case of welded rings. The disadvantages of these prior art extender rings is that welded joints break under heavy traffic and mechanical joints loosen under vibration. Some examples of the patented prior art are shown in the following U.S. Pat. Nos. 1,639,495, 3,408,778, 1,908,909, 3,490,177, 2,903,875, 3,533,199, 3,385,011, 3,629,981, 3,968,600.

Even with the improvements of the above discussed patents, the common way today to raise the level of a manhole cover is through use of shims beneath the ground ring. This, of course, requires that the dirt around the ring be excavated to permit installation of the shims and return of the dirt after such installation.

The objective of this invention is, therefore, to provide a better and more economical means for extending manholes in order to elevate the manhole cover to a new level when street paving takes place. The product of the invention is constructed of inexpensive material and lends itself to more economical manufacturing processes. It also provides a better seat for the manhole cover and is comparatively silent when vehicles pass over the manhole cover. Another advantage of the invention is that the plastic extender ring can be trimmed or tailored in the field to provide a better fit on the manhole base ring and with the cover. The extender ring can be cast as a unitary annular ring or extruded and then cut to size or can be molded in several segments which are joined or seated during usage by caulking or the like. The product is extremely tough and wear-resistant.

Other features and advantages of the invention will become apparent during the course of the following description.

DETAILED DESCRIPTION

Figure 1:
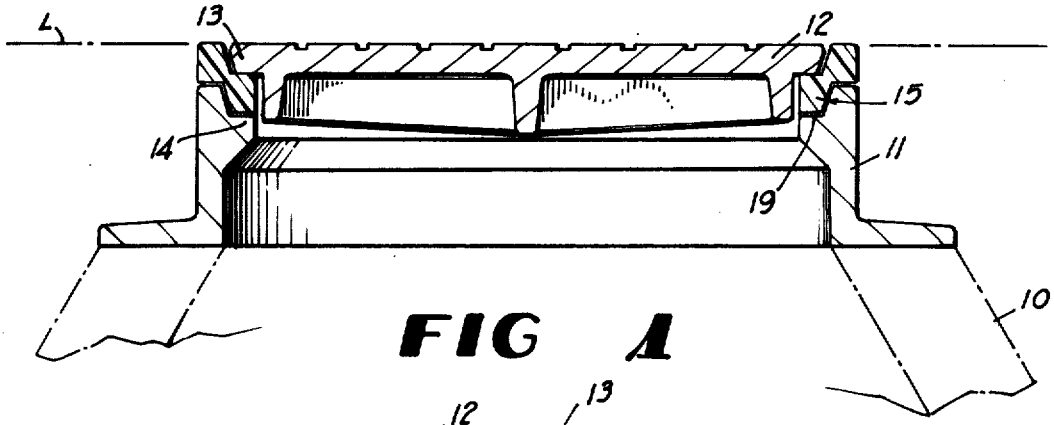
FIG. 1 is a central vertical section through a manhole and manhole cover equipped with a plastic extender ring in accordance with the invention.

Referring to the drawings in detail, wherein like numerals designate like parts, the numeral 10 designates a manhole sub-structure having the usual top ring 11 formed of cast iron for the support of a cast iron manhole cover 12. The cover 12 has an annular marginal flange 13 which normally rests on a depressed annular shoulder 14 or seat formed on the ring 11.

With the passage of time, the street or roadway in which the manhole 10 is located will require repaving and this operation produces a new and elevated pavement level L. Consequently, the manhole cover 12 must be raised to be nearly flush with the new pavement level L and the present invention is embodied in an improved manhole extender means in the form of a plastic extender ring 15, FIG. 1, or plural rings, FIG. 3, to seat and support the cover 12 at the new elevation.

Figure 2:
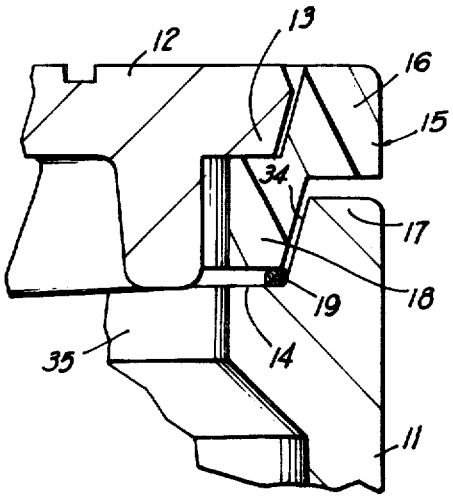
FIG. 2 is an enlarged fragmentary section similar to FIG. 1 showing caulking or another sealant between the plastic extender ring and the manhole base ring.

The plastic extender ring 15, or rings, is shown in FIG. 1 through FIG. 5 as a molded unitary continuous ring being formed of two annular concentric different diameter ring segments or portions of stepped formation to provide an upper larger marginal ring portion 16 disposed outwardly of and surrounding the cover flange 13 during use and disposed immediately above the upper extremity 17 of the base ring 11, FIG. 2. The stepped extender ring 15 also has a lower smaller annular ring section 18 disposed below the cover flange 13 and forming a level radial seat 32 therefor. The lower ring section 18 lies inwardly of and is surrounded by the top extremity 17 of the base ring 11.

In more detail, the extender ring 15, along the bottom portion of lower annular ring section 18, has a flat radially disposed bottom 25. Along the upper portion of upper annular ring section 16, ring 15 has a flat radially disposed upper surface 26, parallel to surface 25. The lower section 18 has a lower outer, frusto conical, peripherial wall 27 which tapers downwardly and inwardly from a flat radial, outwardly protruding, outer shoulder or flange 28, the outer shoulder 28 forming the bottom of the upper section 16, and being parallel to surfaces 25 and 26. The lower edge portion of wall 27 thus joins bottom surface 25 at an obtuse angle equal to the obtuse angle at which it joins outer shoulder 28.

The upper outer peripherial wall 29 of the upper section 16 is cylindrical and extends from shoulder 28 upwardly to merge into an arcuate convex annular corner surface 30 which curves inwardly and, in turn, merges with the outer periphery of upper surface 26. The diameter of wall 29 is equal to the diameter of base ring 11.

At the inner periphery of upper surface 26, the inner upper wall 31 projects downwardly and inwardly, being frusto conical and tapering downwardly to terminate at the outer periphery of the radial seat 32. At the inner periphery of seat 32, the inner lower cylindrical wall 33 extends downwardly to terminate at the inner periphery of bottom surface 25.

It is now seen that the inner radial seat 32 is spaced vertically above and is off set inwardly of but is parallel to shoulder 28 while the surfaces or walls 27 and 31 have the same progressive upwardly increasing diameters, tapers and heights.

These tapers, diameters and heights correspond to the taper diameter and height of inner wall 34 of extremity 17. Also, the seat 32 and bottom surface 25 are of the same inside and outside diameter and cross-sectional widths as the seat 14 while the diameter of wall 33 is about equal to the inside diameter of the inner wall 35 of the manhole.

Therefore, one ring 15 will nest within another with bottom 25 of one ring 15 being received on seat 32 of the other ring 15 as shoulder or flange 28 of one ring is received on surface 26 of the other ring 15.

The extender ring 15 is preferably formed of polypropylene or nylon. The polypropylene is extended by an inert filler, such as fiberglass, talc, chalk, sand or expanded vermiculite. The resulting plastic composition will have a melting point in the vicinity of 500 degrees F. and will not melt at 350 degrees F. but will soften somewhat at this temperature. Asphalt paving material is usually applied to roads at about 300 degrees F. The softening of the plastic extender ring at the asphalt application temperature will actually improve the seating of the heavy manhole cover 12 as the plastic ring will conform to its shape as well as the shape of the support shoulder 14.

The color of the plastic ring 15 is black or dark red to prevent deterioration caused by ultraviolet radiation. Cold flow in the ring 15 is not more than ten per cent and the plastic material is slightly pliable above 250 degrees F. All of these stated physical characteristics of the plastic extender ring 15 contribute toward its improved performance over the customary prior art welded metal extender rings or much more costly adjustable screw-threaded extender means.

Figure 3:
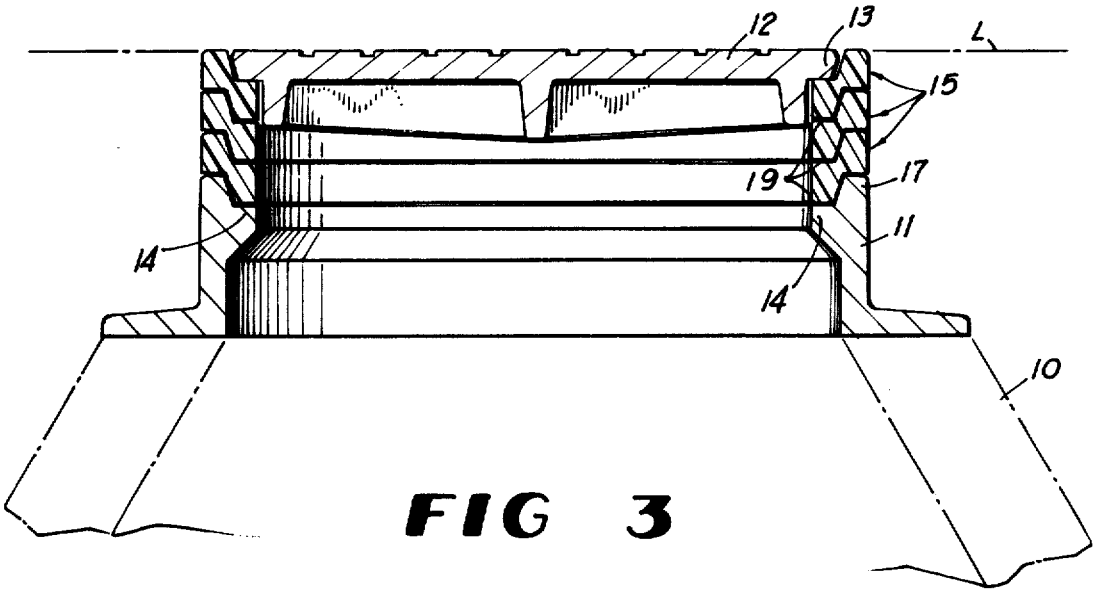
FIG. 3 is a further sectional view similar to FIG. 1 showing the use of plural plastic extender rings according to the invention.
Figure 4:
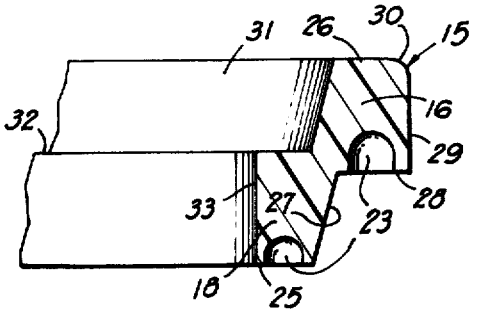
FIG. 4 is a fragmentary section through a molded extender ring.
Figure 5:
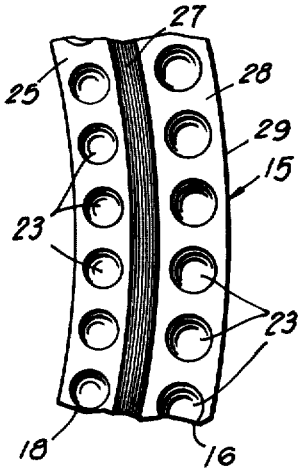
FIG. 5 is a fragmentary bottom plan view thereof.

FIG. 1 illustrates the invention where only a single ring 15 is required to position the manhole cover 12 at the required elevation while FIG. 3 illustrates a condition where three of the rings 15 in nested relationship are employed. Ordinarily, three rings is the maximum number of rings which would be used to elevate the manhole cover.

As shown in FIGS. 1 and 3, the ring or rings 15 are seated on caulking composition 19 or other suitable adhesive. As shown in FIG. 2, this material 19 may be applied as a narrow bead initially and the weight of the manhold cover 12 will spread the caulking or adhesive and actually assist in seating the ring evenly as well as permanently bonding it to the base ring 11 or to other rings 15.

Figure 6:
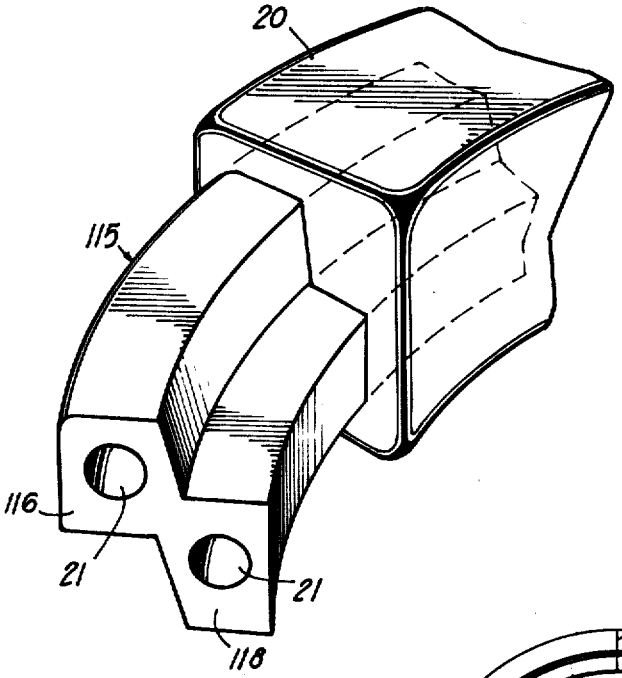
FIG. 6 is a fragmentary perspective view of a second embodiment showing an extruded plastic extender ring and extrusion die.
Figure 7:
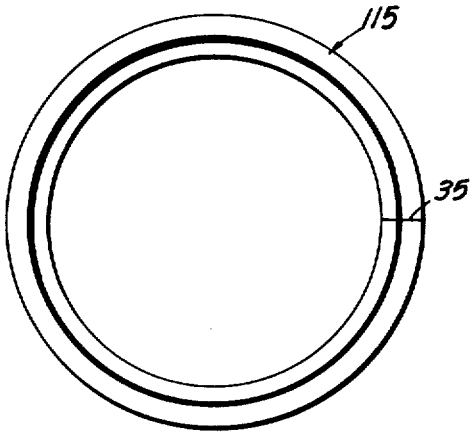
FIG. 7 is a plan view of an extruded ring after cutting to size.

Each ring 15 may, as shown in FIG. 6, be extruded as a helix from a die 20 and cut off to proper length to produce the ring shown in FIG. 7 which is similar to ring 15 except that it may be trimmed for increasing or decreasing its diameter so that it will accurately fit the base ring 11 of a particular manhole. In the extrusion process, the product may be somewhat helical but after cutting to form joint 35, will be urged flat on the base ring 11 due to the weight of the manhole cover 12. Furthermore, the adhesive 19 will secure the extruded ring properly in the installed position. While being extruded, the ring 115 may have circumferential passages 21 formed centrally in the segments 116 and 118 to reduce weight and economize on material. The extrusion process is ideally suited to the invention.

Figure 8:
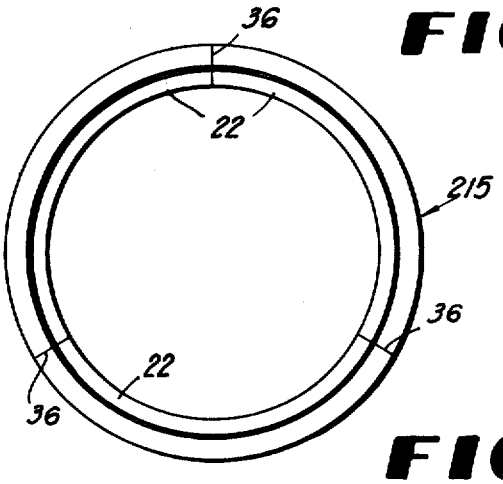
FIG. 8 is a plan view of a third emboidment showing a plural segment molded extender ring embodying the invention.

Alternatively, the ring 215 can be molded in plural arcuate segments 22, FIG. 8, which are joined end-to-end at numerals 36 to make up a complete ring 215. The adhesive or caulking material 19 will serve to hold the segments 22 in assembled relationship. The rings 15 or 115 or 215 may have multiple recesses 23 formed as in its bottom surfaces, or ring 15, FIGS. 4 and 5, to reduce weight and save material and these recesses 23 will also aid in the seating and bonding of the ring in conjunction with the adhesive material 19.

The major advantages of the plastic manhole extender ring are reduced cost of manufacturing and installation, better seating of the manhole cover and less noise when traffic passes over the manhole, and the ability to trim or tailor the ring for a close fit in any particular application.

In practice, the extender ring 15 or rings is simply dropped into place approximately twenty feet ahead of the paving machine and its comparative light weight make the installation much more convenient than the customary digging and shimming or installation of a heavy metal ring by welding. The advantages of the invention over the prior art should now be apparent to anyone skilled in the art.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A manhole extender ring adapted for seating on a manhole structure below pavement level for the purpose of elevating a manhole cover substantially to a newly laid pavement level, said extender ring being unitary and having an inwardly recessed seating surface for receiving a manhole cover such that when said manhole cover is placed upon said seat, a portion of said ring surrounds said manhole cover and an upper surface of said ring will be at about the level of the upper surface of said manhole cover, said extender ring having a height about the upper level of said manhole structure for retaining the newly laid paving material above the level of the manhole structure, said ring having a lower portion for projecting into the upper opening of said manhole structure, said lower portion having spaced flat annular radial upper and lower surfaces and a frusto conical downwardly tapered outer wall joining the inner periphery of the upper surface of said lower portion and the outer periphery of the lower surface of said lower portion, said upper and lower surfaces of said lower portion and said outer wall of said lower portion conforming generally to the shape and dimensions of said manhole structure for seating on the upper and inner edge portions thereof, and said extender ring being composed essentially of plastics material which has a melting point well above the application temperature of asphalt paving material but will soften somewhat at such application temperature.

2. A manhole extender ring as defined in claim 1, wherein said plastics material is polypropylene.

3. A manhole extender ring as defined in claim 1, wherein said plastics material is a polyamide.

4. A manhole extender ring as defined in claim 1, wherein said plastics material forming said extender ring contains an inert filler material.

5. A manhole extender ring as defined in claim 4, and said plastics material is colored to resist deterioration by ultraviolet light.

6. A manhole extender ring as defined in claim 1, and said extender ring formed in plural ring segments which are placed end-to-end during usage to form a substantially complete ring.

7. A manhole extender ring as defined in claim 6, and adhesive material for bonding said ring segments to said manhole structure, to one another and to like segments of another extender ring below said ring.

8. A manhole extender ring as defined in claim 1, and adhesive material for bonding the extender ring to said manhole structure or to another extender ring below said ring.

9. A manhole extender ring as defined in claim 1, and said extender ring being essentially rigid and comprising an extruded ring having internal passage means to reduce the weight of the extender ring.

10. A manhole extender ring as defined in claim 1, and said extender ring being molded and being provided on its bottom with a multiplicity of spaced recesses to reduce weight, save material and improve the seating of the extender ring by increasing its pliability.

11. A manhole extender ring as defined in claim 1, and said extender ring being of stepped formation in cross section to provide an upper outermost annular portion and an integral lower innermost annular portion.

12. A manhole extender ring as defined in claim 11, and a plurality of the extender rings having said stepped formation in nested stacked relation above said manhole structure, and adhesive means joining said plurality of rings in stacked relation and joining the lowermost of said rings with said manhole structure.

13. A manhole extender ring as defined in claim 1, wherein said ring is a single continuous unitary mold member.

14. A manhole extender ring assembly comprising, in combination with a manhole structure and a manhole cover, a unitary annular extender ring composed of resinous plastics material, said ring having two concentric integrally joined annular different diameter upper and lower ring portions of stepped formation, the upper ring portion being of greater diameter than the lower ring portion, said upper ring portion having a flat radially extending upper surface and a frusto conical downwardly converging inner peripheral wall, said lower ring portion having along its upper surface a flat radially extending seat joined at its outer periphery to said inner wall, said upper portion having a flat outer shoulder forming the bottom of the upper portion, said lower portion having a flat downwardly converging outer peripheral wall corresponding generally in height and diameters to said inner wall, said lower portion also including a flat radially extending bottom parallel to said seat and said upper surface, said extender ring being disposed between said manhole structure and said cover, said shoulder being received on the upper surface of said manhole structure with said lower surface being received within the confines of said manhole structure and said manhole cover being received on said seat and within said frusto conical wall of said upper portion, the upper surface of said manhole cover being at about the same level as said upper surface of said upper portion.

15. The assembly defined in claim 14 including a second annular extending ring composed of plastics material and of the same shape and dimensions as the first mentioned extender ring, said second ring being received by and nested with said first mentioned extender ring and wherein said cover is received by said second extender ring.

16. The assembly defined in claim 14 including adhesive along that portion of the extender ring which is abutting said manhole structure.

* * * * *